US010671105B2

(12) United States Patent
Mills et al.

(10) Patent No.: US 10,671,105 B2
(45) Date of Patent: Jun. 2, 2020

(54) MULTI-INPUT VOLTAGE REGULATOR

(71) Applicant: TEXAS INSTRUMENTS INCORPORATED, Dallas, TX (US)

(72) Inventors: Michael James Mills, Plano, TX (US); Anand Kudari, Bangalore (IN); Timothy Bryan Merkin, Richardson, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 134 days.

(21) Appl. No.: 15/913,321

(22) Filed: Mar. 6, 2018

(65) Prior Publication Data

US 2019/0278313 A1 Sep. 12, 2019

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ..... G05F 1/575; G05F 1/59
See application file for complete search history.

(56) References Cited

U.S. PATENT DOCUMENTS

| | | | | |
|---|---|---|---|---|
| 4,928,056 | A | 5/1990 | Pease | |
| 9,696,738 | B2 | 7/2017 | Merkin et al. | |
| 2002/0093317 | A1* | 7/2002 | Matsuda | H02M 1/10 323/273 |
| 2010/0019579 | A1* | 1/2010 | Amerom | G06F 1/263 307/82 |
| 2013/0049611 | A1 | 2/2013 | Wadhwa | |
| 2015/0137780 | A1 | 5/2015 | Lerner et al. | |

OTHER PUBLICATIONS

Search Report for PCT Application No. PCT/US19/20660, dated May 30, 2019, 1 page.

* cited by examiner

*Primary Examiner* — Carlos Amaya
(74) *Attorney, Agent, or Firm* — Micheal A. Davis, Jr.; Charles A. Brill; Frank D. Cimino

(57) ABSTRACT

An apparatus includes an amplifier configured to compare a feedback input, corresponding to a voltage of an output voltage node, with respect to a reference input and to provide a control output to control the output voltage node based on a difference between the feedback input and the reference input. At least two source circuits are coupled with the output voltage node. Each of the source circuits are configured to provide respective voltage sources to supply electrical power to the output voltage node.

16 Claims, 5 Drawing Sheets

MULTI-INPUT VOLTAGE REGULATOR

TECHNICAL FIELD

This disclosure relates to electrical circuits, and more particularly to a voltage regulator circuit configured to regulate an output voltage according to multiple input voltages.

BACKGROUND

A voltage regulator is designed to provide a stable DC voltage independent of the load current, temperature and/or AC line voltage variations. A voltage regulator may use a simple feed-forward design or may include negative feedback. One example regulator is a low-dropout (LDO) regulator that is designed to regulate the output voltage even when the supply voltage is very close to the output voltage. LDO regulators are useful due to low switching noise, small device size, and overall design simplicity. In an LDO circuit where multiple input voltage sources are applied to a common input of the LDO, during transient conditions between the respective sources, a glitch may occur on the input common to the input of the voltage regulator circuit that may adversely affect associated circuitry.

SUMMARY

This disclosure relates to a voltage regulator circuit configured to regulate multiple voltage inputs that are applied at its output node.

In one example, an apparatus includes an amplifier configured to compare a feedback input, corresponding to a voltage of an output voltage node, with respect to a reference input and to provide a control output to control the output node based on a difference between the feedback input and the reference input. At least two source circuits are coupled to the output voltage node. Each of the source circuits are configured to provide respective voltage sources to supply electrical power to the output voltage node.

In another example, a regulator circuit includes an amplifier that includes a control output. The amplifier includes a first input coupled to receive a feedback voltage representing a voltage of an output voltage node and a second input to receive a reference voltage. A switching network includes an output transistor device having a control input coupled to the control output of the amplifier. The output transistor device is configured to regulate the output voltage node in response to the control output and at least two source input voltages coupled to supply power to the output voltage node. At least two source circuits are configured to drive source outputs to the output voltage node in response to the source input voltages. Each source circuit includes a port coupled to receive a respective one of the source input voltages and a respective pass transistor device configured to couple the respective source input voltage to the output voltage node.

In yet another example, a system includes an amplifier configured to provide a control signal based on a feedback signal and a reference signal. Feedback circuitry is configured to provide the feedback signal corresponding to an output voltage at an output voltage node. A plurality of source circuits are included, where each source circuit is configured to receive a respective source voltage and to provide a respective source output to the output voltage node in response to the respective source voltage. A switching network is configured to regulate the output voltage based on the control signal and the respective source voltages.

DETAILED DESCRIPTION

This disclosure relates to a voltage regulator circuit to regulate an output voltage based on multiple input voltage sources. The voltage regulator circuit (e.g., a low drop out (LDO) linear regulator) includes an amplifier to compare a feedback input, corresponding to a voltage of an output voltage node of the regulator, with respect to a reference input. The amplifier (e.g., comparator) provides a control output based on a difference between the feedback input and the reference input. An output transistor device (e.g., metallic oxide semiconductor field effect transistor) regulates the output voltage node in response to the control output from the amplifier and based on multiple input voltages. Each of the multiple input voltage sources is connected to the LDO via a respective source circuit. For example, each source circuit is coupled to provide the input voltage source to the output voltage node of the regulator circuit and to control biasing of the transistor device.

In some examples, the source circuits are configured as low voltage diode OR circuits coupled to the output node of the regulator. This is instead of traditional high voltage diode circuits ORed to the input of existing regulator circuit designs. The low voltage nature of applying the source input voltages through the source circuits to the output node mitigates integrated circuit real estate since lower power components can be fabricated on a smaller area than higher power components. For example, the diode OR circuit can be part of an LDO loop, where each loop fed by its respective source circuit remains active and hence its response to transients are increased over input-driven OR implementations. Output glitches are also decreased and can be set within desired specifications for supply transients, which can avoid an under voltage lockout condition. In some existing regulator circuit designs, current for the regulator is pulled from highest power supply feeding the input of the regulator where each supply is uncorrelated to the other thus leaving the input-driven circuit susceptible to output transients, such as if one of the supplies drops out. The voltage regulator circuit described herein correlates each supply by sensing current of each supply at a common ground pin. Correlated current from each supply is distributed about evenly (limited by mismatch) between two or more input supplies supplying the output node of the regulator which acts to increase transient response.

As used herein, the term "circuit" can include a collection of active and/or passive elements that perform a circuit function, such as an analog circuit or control circuit. Additionally or alternatively, for example, the term "circuit" can include an integrated circuit (IC) where all or some of the circuit elements are fabricated on a common substrate (e.g., semiconductor substrate, such as a die or chip).

Figure 1:
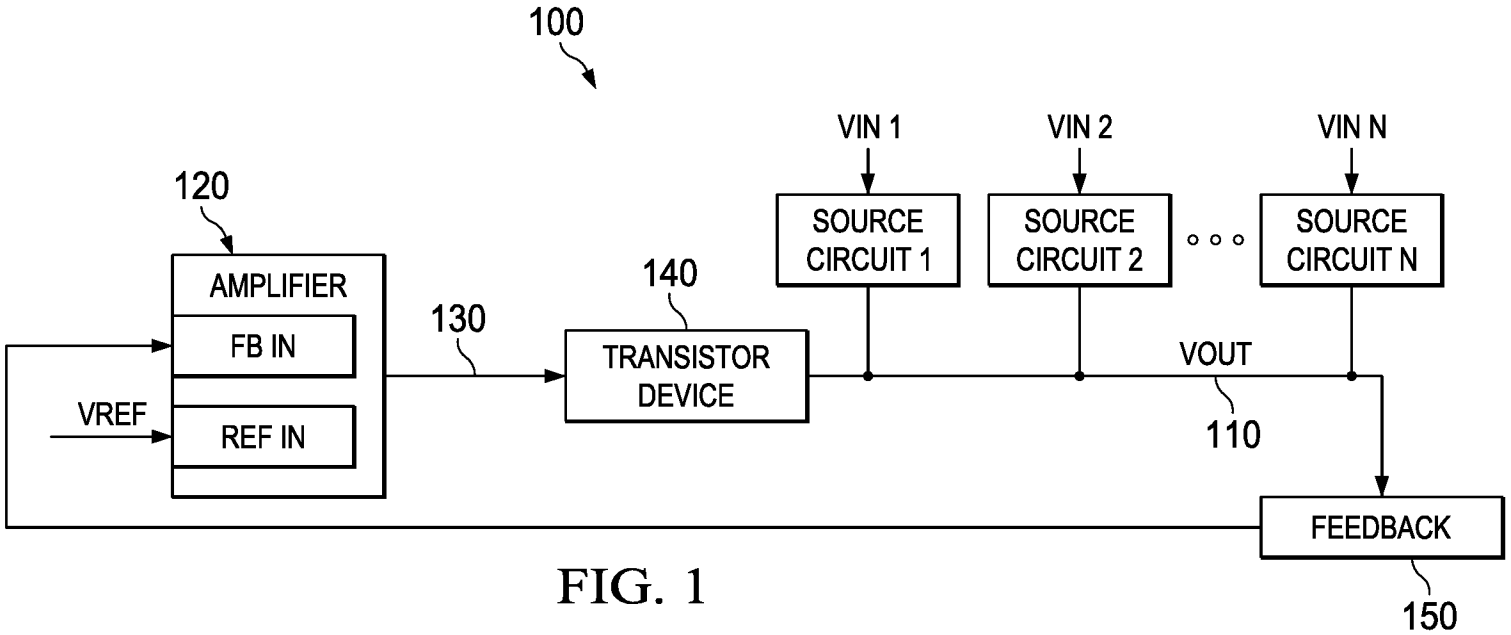
FIG. 1 illustrates an example block diagram of an apparatus to regulate multiple source input voltages that are supplied to an output node of the apparatus.

FIG. 1 illustrates an example of an apparatus 100 configured to provide a regulated output voltage (VOUT) at an output node 110 based on multiple input voltage sources that supply power to the apparatus. The apparatus 100 includes an amplifier 120 configured to compare a feedback input FB IN, corresponding to voltage VOUT of the output voltage node 110, with respect to a reference input REF IN and to provide a control output 130 based on a difference between the feedback input and the reference input. In one example, the amplifier 120 can be a comparator configured with hysteresis to promote stability over environmental and noise conditions. A transistor device 140 is configured to regulate VOUT of the output voltage node 110 in response to the control output 130 from the amplifier 120. As used herein, the term transistor device can include any number of one or more transistors. The transistor device 140 can be provided as part of a switching network, such as that is illustrated and described below with respect to FIGS. 2, 3, and 4. Although shown as external to the amplifier 120 in this example, the transistor device 140 could be incorporated as part of the amplifier 120 in other examples.

In an example, the transistor device 140 can be a metallic oxide field effect transistor having a source, drain, and gate. In another example, the transistor device 140 can be a junction transistor having an emitter, collector, and base in another implementation. At least two source circuits (e.g., voltage source circuits, current source circuits, switching circuits) shown as source circuits 1 through N are coupled to the output voltage node 110. Each of the source circuits 1 through N is configured to provide respective voltage sources shown as VIN 1 through VIN N to the output voltage node 110 from respective source outputs of the source circuits, where N is a positive integer. The voltage sources VIN 1 through VIN N can be received from substantially any voltage source. As an example, the voltage sources may be received from uncorrelated (e.g., independent and/or unrelated) input supplies. For example, each voltage source is a voltage bus that is configured to receive power from a bus power terminal (e.g., point) of universal serial bus (USB) connector, such as USB type C (USB-C), implemented according to one of the USB power delivery (PD) specifications.

As a further example, the transistor device 140 includes a gate or base terminal configured to receive the control output 130, a source or emitter terminal configured to drive the output voltage node 110, and a drain or collector terminal configured to set a current that is drawn through the transistor device, such as is sourced from each of the source circuits 1 through N. A feedback circuit 150 can be configured to sense the voltage VOUT of the output voltage node 110 and to provide feedback to the feedback input FB IN of the amplifier 120. For example, the feedback circuit 150 can include at least one of a resistor divider network or a capacitive network to sense the output voltage VOUT.

In some examples, a universal serial bus (USB) connection can be configured to connect to each of the voltage source inputs VIN 1 through VIN N to receive the respective voltage sources. A controller (not shown, see e.g., FIG. 4) can be configured to operate from the voltage of the output voltage node 110 and to selectively electrically connect the respective voltage sources VIN 1 through VIN N to other circuitry of an associated system (e.g., personal computer or cell phone motherboard), such as in response to the voltage VOUT of the output voltage node 110 reaching a threshold.

Figure 2:
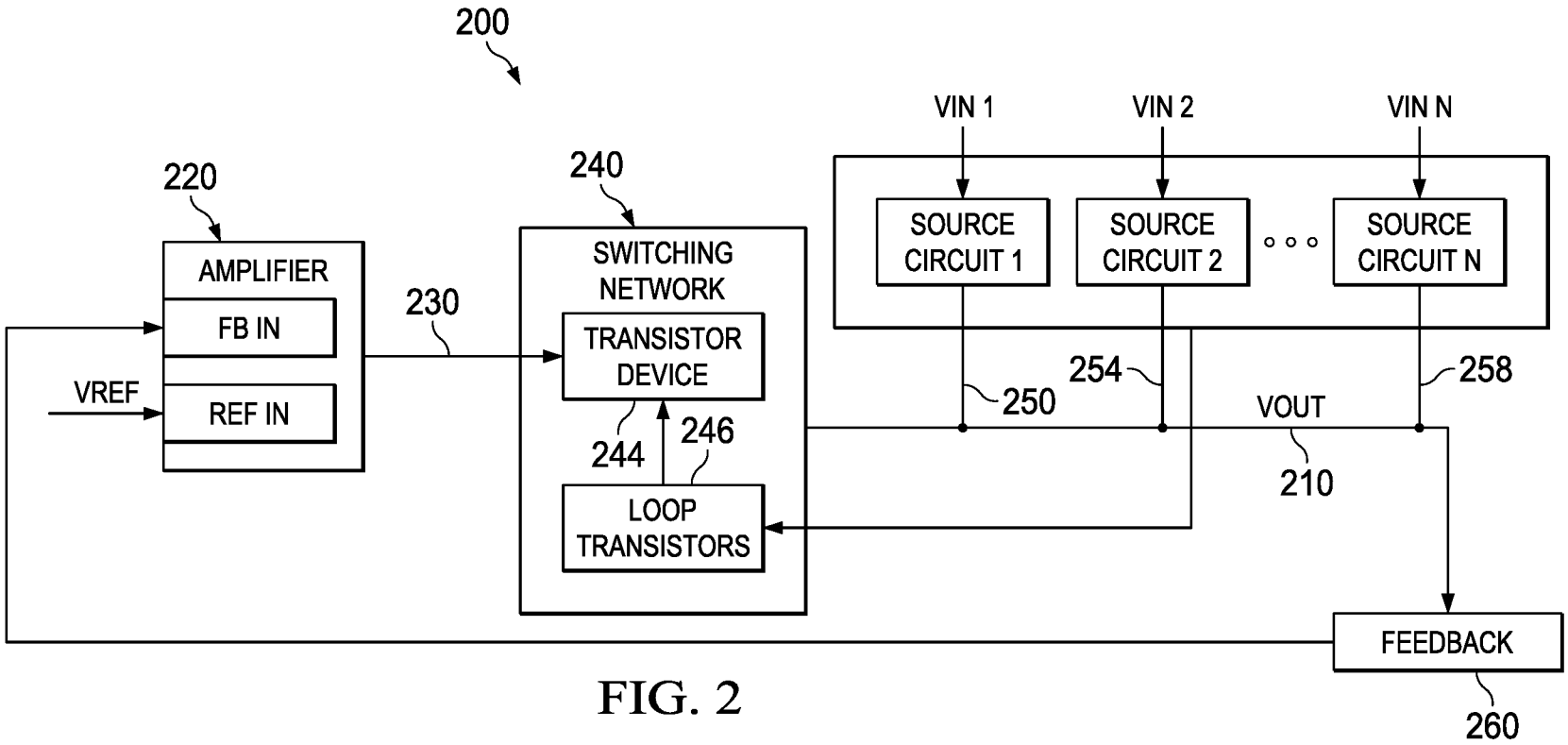
FIG. 2 illustrates an example block diagram of a regulator circuit to regulate multiple source input voltages that are supplied to an output node of the regulator.

FIG. 2 illustrates an example of a regulator circuit 200 configured to provide a regulated output voltage at an output node 210 based on multiple input voltage sources (e.g., uncorrelated supplies) provided to the regulator circuit. The regulator circuit 200 includes an amplifier 220 that includes a control output 230. The amplifier 220 includes a first input FB IN coupled to receive a feedback voltage representing a voltage of the output voltage node 210 and a second input REF IN to receive a reference voltage VREF. A switching network 240 can be provided which includes a transistor device 244 and one or more loop transistor devices 246 which are activated based on input voltage sources and when activated, provide current through transistor device 244. The transistor device 244 includes a control input coupled to the control output 230 of the amplifier 220. The transistor device 244 is configured to regulate the output voltage node 210 in response to the control output 230 and at least two source outputs shown as outputs 250, 254, and 258, which are coupled to the output voltage node 210. A feedback circuit 260 feeds back the voltage VOUT from the output voltage node 210 to the amplifier 220 to generate an error signal configured to cause regulation of the output voltage VOUT with respect to VREF.

At least two source circuits shown as source voltage circuits 1 through N can be configured to drive the source outputs 250-258. Each source circuit 1-N includes a port to receive a respective input voltage source VIN 1 through VIN N and a respective pass transistor device (not shown, see e.g., FIG. 3) configured to couple the respective input voltage source to the output voltage node 210 via the respective source outputs 250-258. The transistor device 244 includes a gate or base terminal configured to receive the control output 230, a source or emitter terminal configured to drive the output voltage node 210, and a drain or collector terminal configured to sense current from each of the source circuits 1-N. The transistor device 244 is coupled to a series resistor (not shown, see e.g., FIG. 3) that is coupled to each source circuit 1-N configured to sense the current from the respective voltage source input VIN 1 through VIN N in response to the respective voltage source being applied to the respective series resistor. Other example aspects of the amplifier 220, switching network 240, source circuits 1-N, and feedback circuit 260 are illustrated and described below with respect to FIG. 3.

Figure 3:
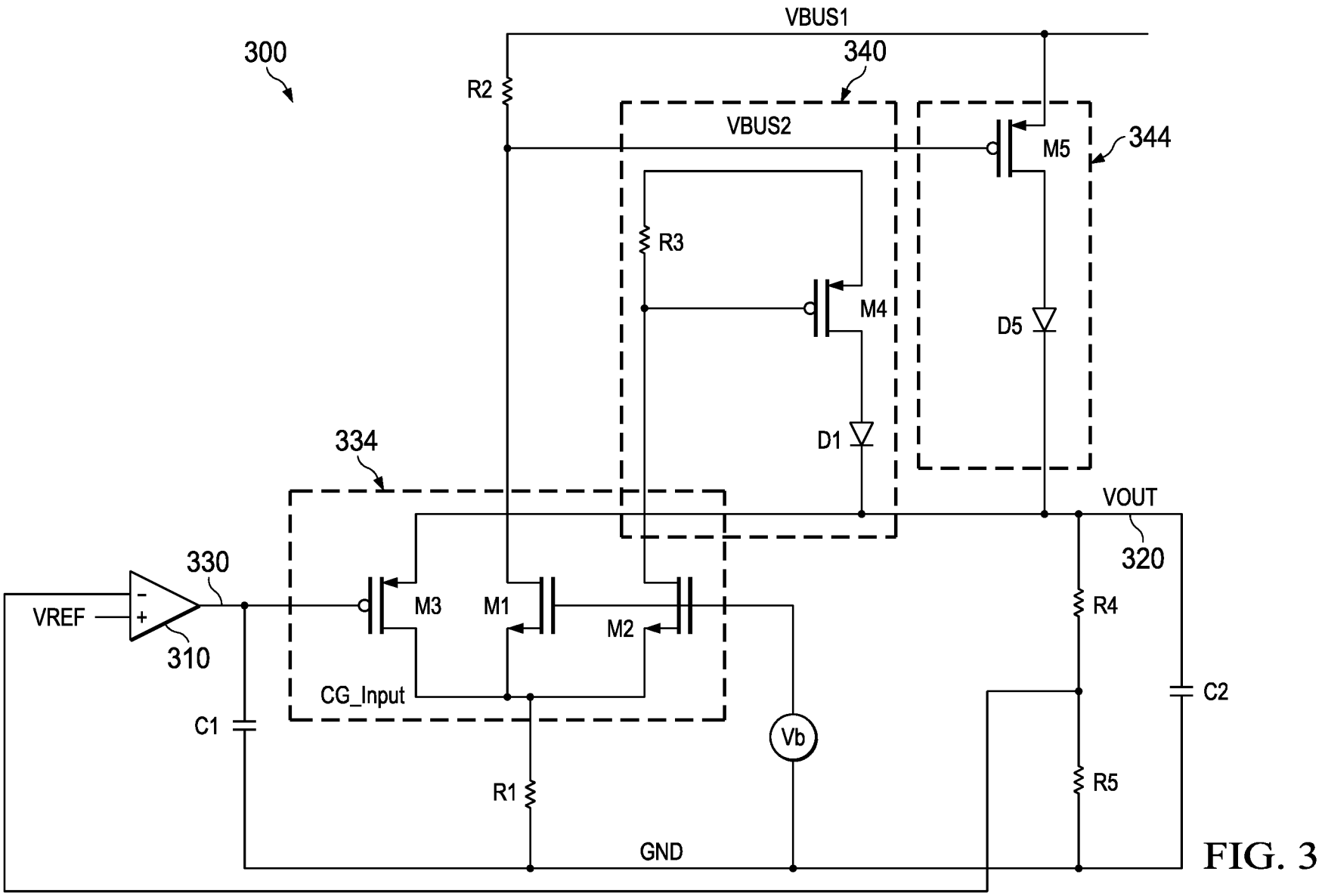
FIG. 3 illustrates an example circuit diagram of a regulator circuit to regulate multiple source input voltages that are supplied to an output node of the regulator.

FIG. 3 illustrates an example of a regulator circuit 300 configured to regulate an output voltage at an output node of the regulator based on multiple input voltage sources. The regulator circuit 300 includes an amplifier 310 configured to compare a feedback input (e.g., at the inverting input of amplifier), corresponding to voltage VOUT of an output voltage node 320 with respect to a reference input (e.g., at the non-inverting input of amplifier) and to provide a control output (e.g., an error signal) 330 based on a difference between the feedback input and the reference input. The reference can be set to a desired magnitude of the regulated output voltage VOUT. A capacitor C1 may be coupled between the amplifier output 330 and ground to remove noise and help stabilize the error signal provided at the control output 330. A transistor device M3 is configured to regulate the output voltage node 320 in response to the control output 330 from the amplifier 310. In the example of FIG. 3, the transistor device M3 forms part of switching network 334 that includes pass transistors M1 and M2. Each of M1 and M2 are coupled to ground (GND) through a resistor R1. R1 is configured to establish current from source circuits 340 and 344, and such current is split by M1 and M2 when input voltages are applied to each source circuit.

In this example, two source circuits 340 and 344 are coupled to the output voltage node 320. There can be any number of two or more such source circuits as mentioned previously. Each of the source circuits 340 and 344 are configured to couple respective voltage sources, shown as VBUS1 and VBUS2, to the output voltage node 320 from power outputs of the respective source circuits.

Also in this example, the transistor device M3 includes a gate terminal coupled to receive the control output from the amplifier 310. A source terminal is coupled to drive the output voltage node 320 with the regulated output voltage VOUT. A drain terminal is coupled to source terminals of M1 and M2 and thus is coupled to ground through R1. The transistors M1 and M2 in the switching network 334 and series resistor R2 and R3 are coupled to each source circuit 340 and 344 and configured to pull current from the respective source circuits 340 and 344 in response to the respective voltage source VBUS1 and VBUS2 and based on the error signal applied to the gate of M3. As shown, a bias voltage supply Vb can be configured to bias the gate terminals of the transistors M1 and M2 (e.g., provide a voltage to bias transistors in linear region to facilitate transient response) coupled to each respective source circuit 340 and 344. Advantageously, the bias voltage Vb can be provided to maintain M1 and M2 active continually, such that the supply loops provided by the source circuits remain active to help improve response to transients. In previous circuit designs, multiple input sources were applied to the input of the regulator circuit. If one of the sources dropped out or came on line, the regulator receiving the sources at its input could produce a transient at its output since there was no correlation between the sources. In the circuit of FIG. 3, correlation is provided by the resistor R1 that is configured to operate as a current source to pull current that is shared through M1 and M2.

As an example, R1 correlates the collective current by providing a common path coupling (e.g., coupling current between respective sources which was not accounted for in existing non-correlated designs) from each of respective series resistors R2 and R3 of the respective source circuits 340 and 344. This correlation and current sharing through M1 and M2 mitigate glitches over prior circuit implementations, such as if one of the supplies VBUS1 or VBUS2 drops out or comes on line after one of the other supplies is already operational. This since each supply loop is active regardless if power via an input source and hence response to transients are direct. Output glitches are thus within desired specification for supply transients. In contrast, conventional circuits pull all current from the highest power supply. The circuit of FIG. 3 distributes the current between supplies substantially equally (e.g., only limited by mismatch) between two input supplies. As a result, under voltage lockout condition may be reduced or avoided altogether in such circumstances.

In the example of FIG. 3, each of the source circuits 340 and 344 include a respective pass transistor device M4 and M5 configured to provide power from the respective voltage sources VBUS1 and VBUS2 to the output voltage node 320. Each of the respective transistor devices M4 and M5 include a drain or collector that is coupled to a diode D1 or D5 configured to couple power from the respective pass transistor device to the output voltage node 320. In one example, each of the diodes D1 and D2 can be implemented as a low power transistor device that includes a gate or base connection that is switched and configured to lower the voltage drop across the diode. An example of such low power diode is illustrated and described in U.S. Pat. No. 9,696,738, entitled LOW POWER IDEAL DIODE CONTROL CIRCUIT, which is incorporated herein by reference.

A feedback circuit (e.g., R4 and R5 in this example) is configured to sense the voltage of the output voltage VOUT and to provide feedback to the feedback input of the amplifier 310. For example, the feedback circuit is configured as a resistive voltage divider that includes resistors R4 and R5 connected between the output node 320 and ground. The node between R4 and R5 thus provides the feedback to the inverting input of the amplifier 310. A capacitor C2 is connected in parallel can provide low pass output filtering of the regulator circuit 300 to further help stabilize the regulated output voltage VOUT.

As noted previously, the feedback circuit can include at least one of a resistor divider network, a capacitive network, or other sensor, for example. A universal serial bus (USB) connection can be provided to each of the voltage source inputs to provide the respective voltage sources VBUS1 and VBUS2. A controller (not shown, see e.g., FIG. 4) can be configured to operate from the voltage of the output voltage node 320 and to switch the respective voltage sources VBUS1 and VBUS2 to another system based on the voltage of the output voltage node reaching a threshold.

Figure 4:
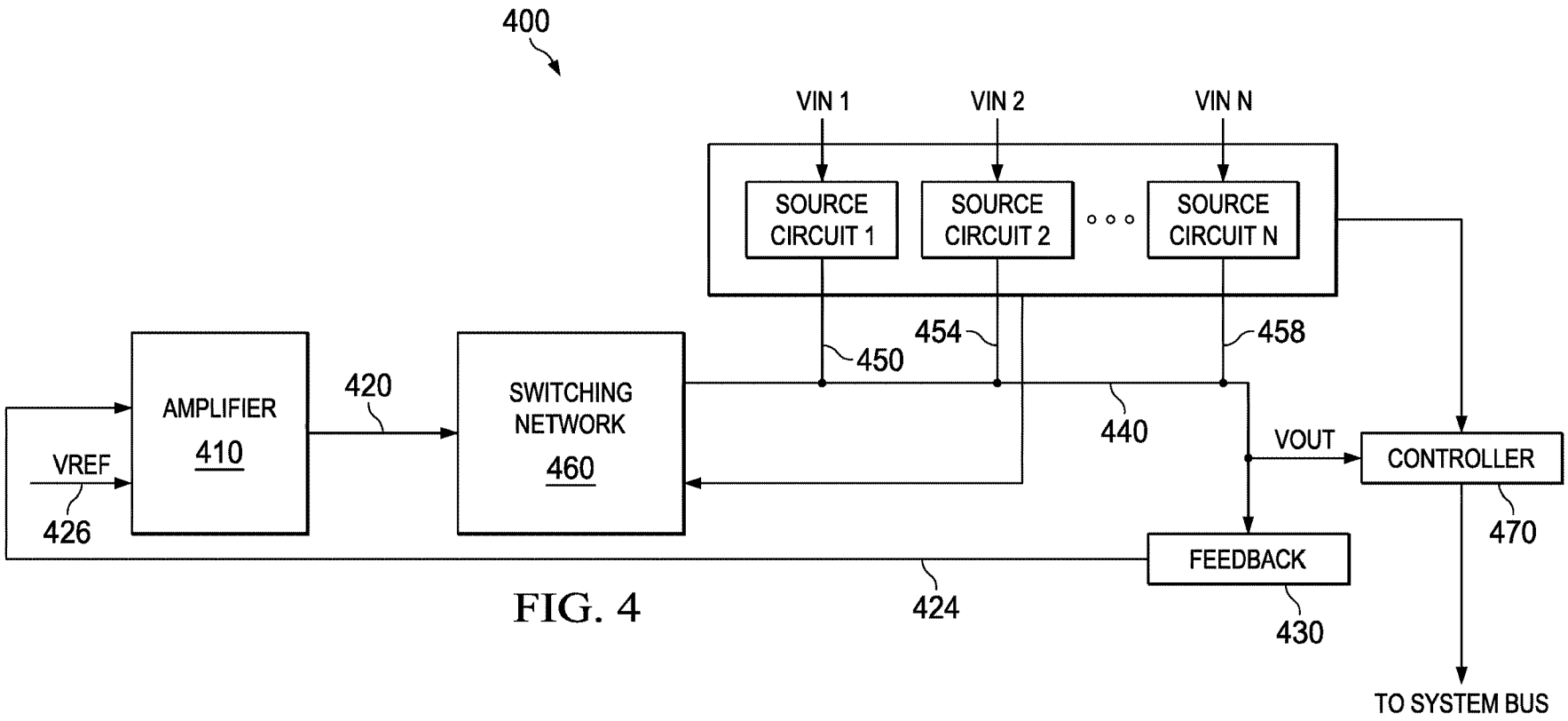
FIG. 4 illustrates an example of a system to regulate multiple source input voltages that are supplied to an output node of the regulator.

FIG. 4 illustrates an example of a system 400 configured to provide a regulated output voltage VOUT at an output node of the regulator according to multiple input voltage sources supplied to the system. The system 400 includes an amplifier 410 configured to provide a control signal 420 based on an error determined from a difference between a feedback signal 424 and a reference signal 426. Feedback circuitry 430 is configured to provide the feedback signal 424 corresponding to the output voltage VOUT at an output node (e.g., an output terminal) 440.

A plurality of source circuits shown as source circuit 1 through N are coupled to the output node 440. Each source circuit 1-N is configured to receive a respective source voltage VIN 1 through VIN N and to supply a respective source output at 450, 454, and 458 to the output voltage node 440 in response to the respective source voltage. A switching network 460 is configured to cooperate with the amplifier 410 to regulate the output voltage VOUT based on the control signal 420 and the respective source voltages VIN 1-VIN N.

As a further example, a controller 470 can be coupled to receive the regulated output voltage VOUT. As an example, at power up from when VOUT is off, the amplifier and switching network draw power from the respective source voltages VIN 1-VIN N until the regulated VOUT is provided at 440. In response to VOUT reaching a threshold level (e.g., 3.3 V), at the output voltage of the output voltage node 440, the controller 470 itself is activated and can control power delivery to other system components. As an example, the controller 470 switches the respective voltage sources VIN 1-VIN N to one or more other system buses (not shown) based on the voltage of the output voltage node reaching a threshold. An example of another system bus could be power applied to a personal computer motherboard bus, a cell phone motherboard bus, or substantially any type of bus that may need switched power from a controller. For example, the controller 470 and the system 400 can be fabricated on a substrate of an integrated circuit forming a power management chip.

Figure 5:
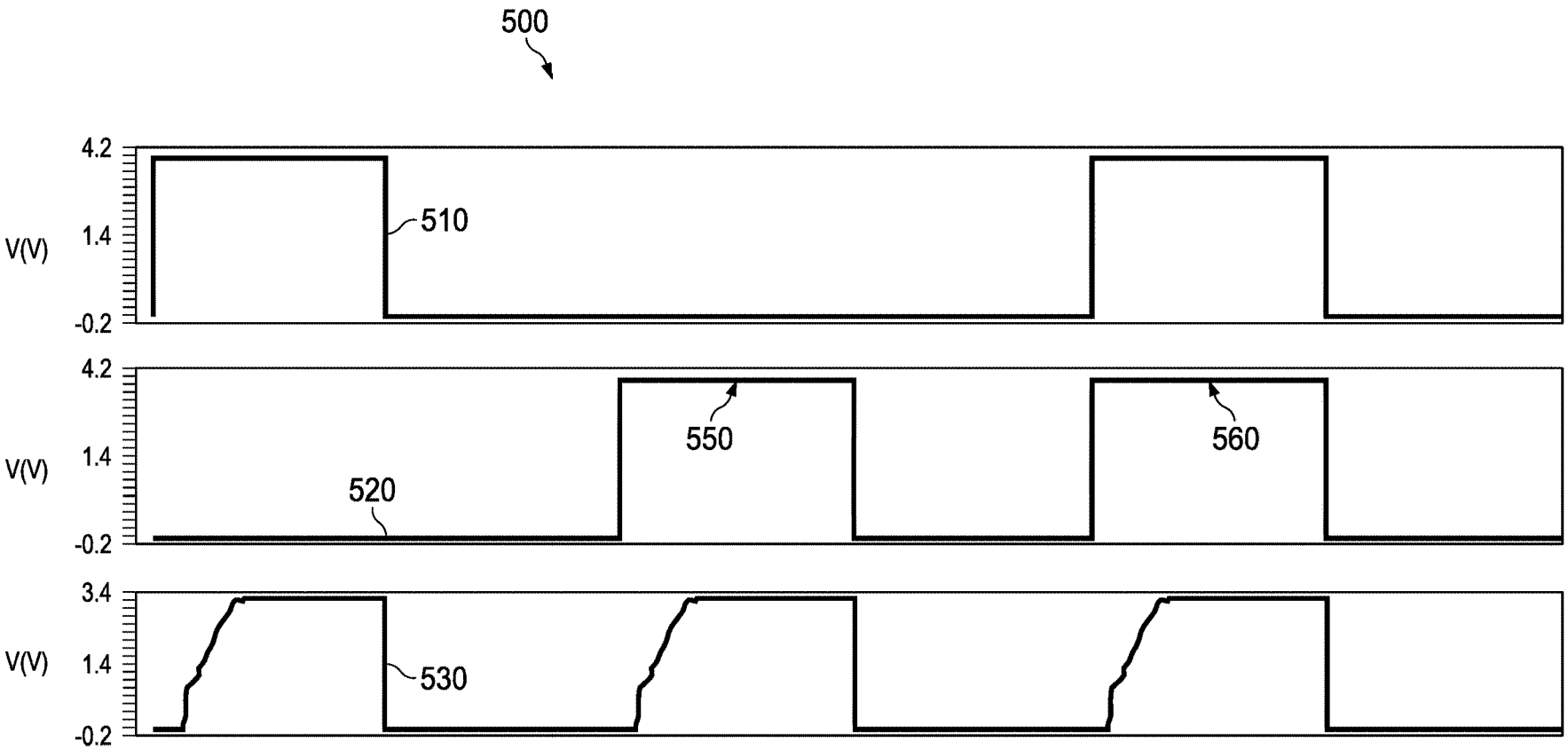
FIG. 5 illustrates an example timing and voltage diagram of multiple input voltage switching and its effect on regulator output voltage.

FIG. 5 illustrates an example timing and voltage diagram 500 of multiple input voltage switching and its effect on regulator output voltage. Voltage in volts is represented on the vertical axis of the diagram 500 whereas time is represented in milliseconds. A signal 510 represents a source input voltage represented as VBUS1 in FIG. 3. A signal 520 represents a source input voltage represented as VBUS2 in FIG. 3. A signal 530 represents the linear regulator output at node 320 of FIG. 3 in response to the input source bus voltages represented by signals 510 and 520. As shown, output of the regulator is at zero when both the source voltage 510 and 520 are off. If one or the other of the voltages is present such as shown at 550, then the output voltage of 530 is in regulation. If both of the voltages are present such as shown at 560, then the output voltage is also in regulation.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An apparatus, comprising:

an amplifier configured to compare a feedback input, corresponding to a voltage of an output voltage node, with respect to a reference input and to provide a control output to control the voltage of the output voltage node based on a difference between the feedback input and the reference input;

at least two source circuits coupled with the output voltage node, each of the source circuits configured to provide respective voltage sources to supply electrical power to the output voltage node;

an output transistor device configured to regulate the output voltage node in response to the control output from the amplifier, wherein the transistor device includes a gate terminal coupled to receive the control output, a source terminal coupled to drive the output voltage node; and a loop transistor device coupled between at least one of the two source circuits and a drain terminal of the output transistor device.

2. The apparatus of claim 1, wherein the drain terminal of the output transistor device is coupled to provide current from at least one of the two source circuits.

3. The apparatus of claim 1, further comprising a bias voltage supply configured to bias a gate terminal of each of the loop transistor devices coupled with each respective source circuit.

4. The apparatus of claim 1, further comprising a common ground (CG) resistor that couples the drain terminal of the output transistor device and the source terminal of each of the loop transistor devices to ground, wherein the CG resistor is configured to establish an aggregate current from each of the respective source circuits and the output transistor device.

5. The apparatus of claim 1, wherein each of the source circuits further comprises a respective pass transistor device configured to provide power from the respective voltage sources to the output voltage node.

6. The apparatus of claim 5, wherein each of the source circuits further comprises a diode coupled between a drain of the respective pass transistor device and the output voltage node such that the diodes collectively are configured as a diode-OR circuit.

7. The apparatus of claim 1, further comprising a feedback circuit configured to sense the voltage of the output voltage node and to provide feedback to the feedback input of the amplifier.

8. The apparatus of claim 7, wherein the feedback circuit includes a divider network connected between the output voltage node and ground, an intermediate node of the divider network being connected to an input of the amplifier.

9. The apparatus of claim 1, wherein each of the source circuits is configured to receive the respective voltage sources from a power terminal of a universal serial bus.

10. The apparatus of claim 1, further comprising a controller connected to operate based on the voltage of the output voltage node and to switch at least one of the respective voltage sources to another system based on the voltage of the output voltage node reaching a threshold, wherein the apparatus is fabricated on a substrate of an integrated circuit.

11. A regulator circuit, comprising:

an amplifier that includes a control output, the amplifier having a first input coupled to receive a feedback voltage representing a voltage of an output voltage node and a second input to receive a reference voltage;

a switching network that includes an output transistor device having a control input coupled with the control output of the amplifier, the output transistor device configured to regulate the output voltage node in response to the control output;

at least two source circuits coupled to the output voltage node, each of the two source circuits including a port coupled to receive a respective one of two source input voltages, and a respective pass transistor device configured to couple the respective source input voltage to the output voltage node; and a loop transistor device coupled between at least one of the two source circuits and a drain of the output transistor device.

12. The regulator circuit of claim 11, wherein the output transistor device includes a gate terminal coupled to receive the control output, a source terminal coupled to drive the output voltage node, and a drain terminal coupled to provide current from each of the source circuits.

13. The regulator circuit of claim 11, further comprising a common ground (CG) resistor that couples the drain terminal of the output transistor device and the source terminal of each of the loop transistor devices to ground, wherein the CG resistor is configured to establish an aggregate current from each of the respective source circuits and the output transistor device.

14. The regulator circuit of claim 11, further comprising a feedback circuit configured to sense the voltage of the output voltage node and to provide the feedback voltage to the first input of the amplifier.

15. The regulator circuit of claim 11, wherein each of the source circuits further comprises a diode coupled between a drain of the respective pass transistor device and the output voltage node such that the diodes collectively are configured as a diode-OR circuit.

16. The regulator circuit of claim 11, further comprising a controller configured to operate in response to the voltage of the output voltage node and to connect the respective voltage sources to at least one other system bus based on the voltage of the output voltage node reaching a threshold.

* * * * *